US009156635B2

(12) United States Patent
Nguyen

(10) Patent No.: US 9,156,635 B2
(45) Date of Patent: Oct. 13, 2015

(54) IMAGE FORMING DEVICE HAVING CONVEYING UNIT

(71) Applicant: Kien Trung Nguyen, Nagoya (JP)

(72) Inventor: Kien Trung Nguyen, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/224,351

(22) Filed: Mar. 25, 2014

(65) Prior Publication Data

US 2014/0291929 A1 Oct. 2, 2014

(30) Foreign Application Priority Data

Mar. 29, 2013 (JP) ..... 2013-070864

(51) Int. Cl.

| | |
|---|---|
| ***B65H 3/00*** | (2006.01) |
| ***B65H 1/26*** | (2006.01) |
| ***B65H 85/00*** | (2006.01) |
| ***B65H 5/06*** | (2006.01) |
| ***B65H 9/16*** | (2006.01) |

(52) U.S. Cl.

CPC ..... *B65H 1/266* (2013.01); *B65H 5/062* (2013.01); *B65H 9/166* (2013.01); *B65H 85/00* (2013.01); *B65H 2402/441* (2013.01); *B65H 2402/443* (2013.01); *B65H 2404/144* (2013.01); *B65H 2404/15212* (2013.01); *B65H 2404/611* (2013.01); *B65H 2405/111* (2013.01); *B65H 2407/33* (2013.01); *B65H 2601/321* (2013.01); *B65H 2801/09* (2013.01)

(58) Field of Classification Search

CPC ..... B65H 2402/441; B65H 2402/443; B65H 2407/33; B65H 2601/321

USPC ..... 271/162, 164, 273

See application file for complete search history.

(56) References Cited

U.S. PATENT DOCUMENTS

| | | | | |
|---|---|---|---|---|
| 6,695,303 | B2 * | 2/2004 | Okada et al. | 271/9.12 |
| 2007/0057438 | A1 * | 3/2007 | Kurokawa et al. | 271/164 |
| 2012/0104678 | A1 | 5/2012 | Iino et al. | |
| 2012/0126475 | A1 * | 5/2012 | Shin et al. | 271/117 |

FOREIGN PATENT DOCUMENTS

| | | | |
|---|---|---|---|
| JP | 9-286542 | A | 11/1997 |
| JP | 2001-63867 | A | 3/2001 |
| JP | 2002-302293 | A | 10/2002 |
| JP | 2004-18217 | A | 1/2004 |
| JP | 2012-96858 | A | 5/2012 |

* cited by examiner

*Primary Examiner* — Howard Sanders

(74) *Attorney, Agent, or Firm* — Merchant & Gould PC

(57) ABSTRACT

An image forming device includes a housing; a sheet tray; an image-forming unit; a conveying unit; and a switching mechanism. The sheet tray is detachably housed in the housing. The image-forming unit is configured to form an image on a sheet conveyed from the sheet tray. The conveying unit includes a first roller and a second roller configured to nip and convey the sheet on which the image is formed by the image-forming unit to the image-forming unit. The switching mechanism is disposed between the sheet tray and the conveying unit and configured to bring the first roller and the second roller to be in peripheral contact with each other in conjunction with a loading operation of the sheet tray into the housing and separate the first roller and the second roller in conjunction with an unloading operation of the sheet tray from the housing.

10 Claims, 11 Drawing Sheets

IMAGE FORMING DEVICE HAVING CONVEYING UNIT

CROSS REFERENCE TO RELATED APPLICATION

This application claims priority from Japanese Patent Application No. 2013-070864 filed Mar. 29, 2013. The entire content of the priority application is incorporated herein by reference.

TECHNICAL FIELD

The present invention relates to an image forming device.

BACKGROUND

One image forming device known in the art has a housing, a sheet tray, an image-forming unit and a conveying unit (Japanese Patent Application Publication No. 2012-96858, for example). In this conventional image forming device, the sheet tray is detachably housed in the housing and accommodates sheets. The image-forming unit is disposed in the housing and forms an image on a sheet that is conveyed from the sheet tray. The conveying unit is disposed in the housing and conveys the sheet on which the image has been formed by the image-forming unit again to the image-forming unit. More specifically, the conveying unit includes a first roller and a second roller. The first roller and the second roller convey the sheet on which the image has been formed by the image-forming unit by interposing it therebetween.

With this conventional image forming device, when a sheet gets jammed in the conveying unit, the sheet tray is detached from the housing, allowing a user to easily put his/her hand into the conveying unit to remove the sheet jammed in the conveying unit.

SUMMARY

However, with the conventional image forming device described above, even after the sheet tray is detached from the housing, the jammed sheet still remains nipped between the first and second rollers of the conveying unit. Therefore, when the user holds the sheet with his/her fingers putted into the conveying unit and forcibly pulls it out, the sheet may tear and remain in the conveying unit. Thus, with the conventional image forming device, it might be difficult to remove the sheet jammed in the conveying unit.

In view of the foregoing, it is an object of the present invention to provide an image forming device that enables a sheet jammed in a conveying unit to be easily removed.

In order to attain the above and other objects, the present invention provides an image forming device that includes a housing; a sheet tray; an image-forming unit; a conveying unit; and a switching mechanism. The sheet tray is detachably housed in the housing and configured to accommodate a sheet. The image-forming unit is disposed in the housing and configured to form an image on the sheet conveyed from the sheet tray. The conveying unit is disposed in the housing and includes a first roller and a second roller. The first roller and the second roller are configured to nip and convey the sheet on which the image is formed by the image-forming unit to the image-forming unit. The switching mechanism is disposed between the sheet tray and the conveying unit and configured to bring the first roller and the second roller to be in peripheral contact with each other in conjunction with a loading operation of the sheet tray into the housing and separate the first roller and the second roller in conjunction with an unloading operation of the sheet tray from the housing.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
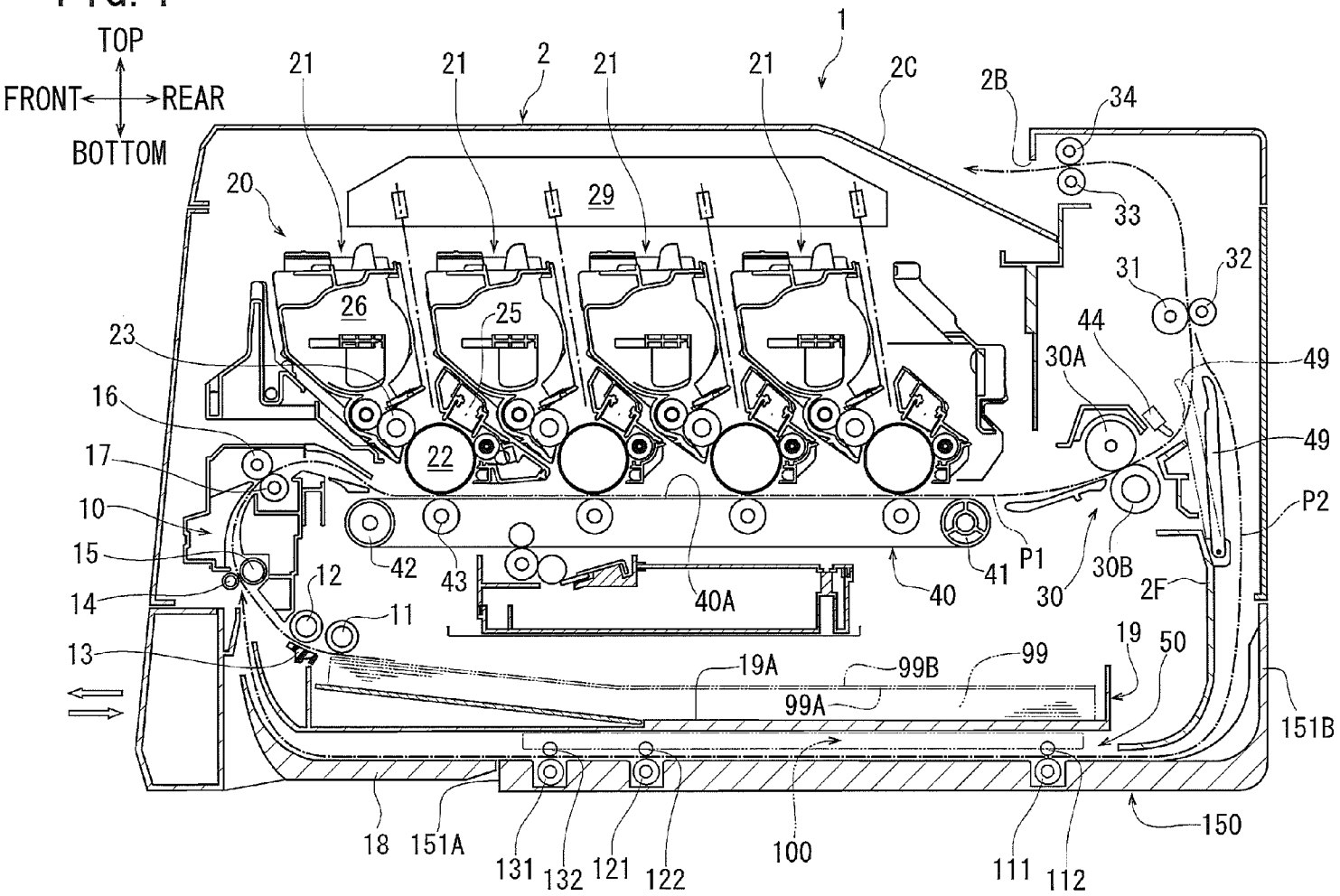
FIG. 1 is a schematic cross-sectional view illustrating an image forming device according to a first embodiment of the present invention.

An image forming device according to embodiments of the present invention will be described while referring to the accompanying drawings wherein like parts and components are designated by the same reference numerals to avoid duplicating description.

An image forming device shown in FIG. 1 is an example of an image forming device according to a first embodiment of the present invention. The image forming device 1 is a color laser printer that forms an image of a plurality of colors on a sheet 99 such as a sheet of paper or an OHP sheet by employing an electro-photographic system. The terms "upward", "downward", "upper", "lower", "above", "below", "right", "left", "front", "rear" and the like will be used throughout the description assuming that the image forming device 1 is disposed on a level surface as shown in FIG. 1. More specifically, in FIG. 1, a right side, a left side, a near side and a far side will be referred to as a rear side, a front side, a right side and a left side of the image forming device 1, respectively.

As shown in FIG. 1, the image forming device 1 includes a housing 2 that is formed in a general box-like shape. A frame member (not shown) is provided in the housing 2. A discharge tray 2C and a discharge opening 2B are formed on the upper surface of the housing 2. The discharge tray 2C is made concave in such a way as to be inclined downward to the rear side. The discharge opening 2B is disposed above the rear edge of the discharge tray 2C, and allows the inside of the housing 2 to communicate with the outside.

The image forming device 1 also includes a sheet tray 19. The sheet tray 19 is detachably housed in the housing 2. The sheet tray 19 is disposed in the lower portion of the housing 2. The sheet tray 19 is formed in a general box-like shape, and the upper portion of the sheet tray 19 is opened. A sheet placement surface 19A is formed inside the sheet tray 19. The sheet placement surface 19A is a plane that extends substantially in a horizontal direction. A plurality of sheets 99 is accommodated in the sheet tray 19 and supported from the lower side thereof by the sheet placement surface 19A.

The sheet tray 19 is detached from the housing 2 as an unloading operation of withdrawing the sheet tray 19 from the location shown in FIG. 1 toward the front direction is carried out. The sheet tray 19 is attached to the housing as a loading operation of pushing the sheet tray 19 toward the rear side in such a way that the sheet tray 19 moves into the housing 2 from the front side of the housing 2 is carried out. That is, the attaching-and-detaching direction in which the sheet tray 19 is attached to and detached from the housing 2 is the front-rear direction, and is substantially parallel to the sheet placement surface 19A. The attaching-and-detaching direction is an example of a second direction of the present invention.

The image forming device 1 further includes a supply unit 10, a conveying belt 40, an image-forming unit 20, an exposing unit 29, a fixing unit 30, first discharge rollers 31 and 32, second discharge rollers 33 and 34, a flapper 49, and a conveying unit 50 in the housing 2. A first conveyance path P1 and a second conveyance path P2 are provided in the housing 2.

The first conveyance path P1 extends from the front end of the sheet tray 19 in an upper and front direction, passes through the supply unit 10, and makes a turn to the rear side before extending substantially in the horizontal direction and passing between the upper side of the conveying belt 40 and the lower side of the image-forming unit 20. Then, the first conveyance path P1 passes through the fixing unit 30, makes a turn to the upper side, and then passes between the first discharge rollers 31 and 32. Then, the first conveyance path P1 makes a turn to the front side, extends substantially in the horizontal direction, passes between the second discharge rollers 33 and 34, and reaches the discharge tray 2C via the discharge opening 2B. One surface 99A of a sheet 99 faces downward when the sheet 99 is placed on the sheet tray 19, and faces upwards when passing below the image-forming unit 20.

The second conveyance path P2 extends in a direction opposite to the direction in which a sheet 99 is discharged from the second discharge rollers 33 and 34 to the discharge tray 2C, and makes a turn to the lower side before passing between the first discharge rollers 31 and 32. Then, the second conveyance path P2 makes a turn to the front side below the rear end portion of the sheet tray 19, extends substantially in the horizontal direction between the sheet tray 19 and the bottom wall of the housing 2, and then passes through the conveying unit 50. Then, the second conveyance path P2 makes a turn to the upper side ahead of the front end of the sheet tray 19 before joining the first conveyance path P1. The one surface 99A of the sheet 99 faces upward when passing through the conveying unit 50, and the other surface 99B of the sheet 99 faces upward when moving into the first conveyance path P1 from the second conveyance path P2 and passing below the image-forming unit 20.

The supply unit 10 includes a supply roller 11, a separation roller 12, a separation pad 13, conveyance rollers 14 and 15, and registration rollers 16 and 17. The first conveyance path P1 includes a general U-shaped portion so as to make a turn to the rear side. The conveyance rollers 14 and 15 and the registration rollers 16 and 17 are disposed in the U-shaped portion of the first conveyance path P1. The supply roller 11, the separation roller 12, and the separation pad 13 send each of sheets 99 stacked in the sheet tray 19 to the first conveyance path P1. Then, the conveyance rollers 14 and 15 and the registration rollers 16 and 17 convey the sheet 99 toward the conveying belt 40 and the image-forming unit 20.

The conveying belt 40 is provided above the sheet tray 19 and below the image-forming unit 20. A drive roller 41 is positioned in the rear portion of the housing 2, and a follow roller 42 is in the front portion of the housing 2. The conveying belt 40 is an endless belt which is looped around the drive roller 41 and the follow roller 42, and circulates when the drive roller 41 is driven to rotate. The conveying belt 40 defines a transfer plane 40A.

The transfer plane 40A is a general horizontal plane that extends from the drive roller 41 to the follow roller 42 along a general horizontal portion of the first conveyance path P1 in the left-right and front-rear directions. The conveying belt 40 moves rearward on the transfer plane 40A. A sheet 99 that has been carried by the supply unit 10 from the sheet tray 19 along the first conveyance path P1 is attracted to the transfer plane 40A when being conveyed, and passes below the image-forming unit 20.

The image-forming unit 20 is of a so-called direct tandem type. The image-forming unit 20 includes four process units 21 that correspond to four colors, i.e., cyan, magenta, yellow, and black, respectively. The process units 21 each are positioned above the conveying belt 40 with the general horizontal portion of the first conveyance path P1 intervened therebetween. The process units 21 are arranged in the front-rear direction along the general horizontal portion of the first conveyance path P1. Each of the process units 21 includes a photosensitive drum 22, a developing roller 23, a toner storage unit 26, and a charging unit 25.

The photosensitive drum 22 contacts the transfer plane 40A from the upper side thereof and the general horizontal portion of the first conveyance path P1 is interposed therebetween. The photosensitive drum 22 comes in contact with the one surface 99A of the conveyed sheet 99 and rotates counterclockwise in a right side view in synchronization with the rearward movement of the transfer plane 40A. When the sheet 99 is conveyed again, the photosensitive drum 22 comes in contact with the other surface 99B of the conveyed sheet 99 and rotates counterclockwise in a right side view. Four transfer rollers 43 are provided below the transfer plane 40A. The transfer rollers 43 each confront the photosensitive drums 22 of the corresponding process units 21 with the transfer plane 40A interposed therebetween.

The developing roller 23 contacts the corresponding photosensitive drum 22 from the diagonally-upper and front side thereof. The toner storage unit 26 is disposed on the diagonally-upper and front side of the corresponding photosensitive drum 22. Toner of a corresponding color is stored in the toner storage unit 26. The developing roller 23 supplies the toner in the toner storage unit 26 to the photosensitive drum 22.

The charging unit 25 confronts the corresponding photosensitive drum 22 from the diagonally-upper and rear side thereof. The charging unit 25 applies a positive charge to the surface of the corresponding photosensitive drum 22 in a non-contact manner through a charging wire extending in the left-right direction.

The exposing unit 29 is provided above the image-forming unit 20 in the housing 2. The exposing unit 29 includes laser beam sources, polygon mirrors, fθ lenses, reflecting mirrors, and the like. The exposing unit 29 emits laser beams to the photosensitive drums 22 of the process units 21 from above.

The fixing unit 30 is provided behind the drive roller 41 of the conveying belt 40. The fixing unit 30 includes a heating roller 30A and a pressure roller 30B. The heating roller 30A is disposed on the upper side, and the pressure roller 30B is on the lower side. The heating roller 30A and the pressure roller 30B confront each other with the first conveyance path P1 interposed therebetween. The surface of the heating roller 30A is heated and comes in contact with the conveyed sheet 99. The pressure roller 30B confronts the heating roller 30A and is urged against the heating roller 30A. In this manner, the fixing unit 30 heats and presses the sheet 99 that has passed below the image-forming unit 20 by using the heating roller 30A and the pressure roller 30B.

A discharge sensor 44 is provided behind the heating roller 30A and the pressure roller 30B so that the discharge sensor 44 confronts the first conveyance path P1. The discharge sensor 44 is, for example, designed to use an optical sensor, such as a photo interrupter, to detect the displacement of an actuator that comes in contact with a sheet 99 to swing. After the discharge sensor 44 detects a sheet 99 passing through the fixing unit 30, the detection results are transmitted to a control unit (not shown). The control unit controls the timing of activating and stopping each component based on the detection results during the image-forming operation.

The image-forming unit 20, the exposing unit 29, and the fixing unit 30 work in the following manner to form an image on a sheet 99 that is conveyed on the transfer plane 40A along the first conveyance path P1. That is, the surface of the photosensitive drum 22 is uniformly charged positively by the charging unit 25 as the photosensitive drum 22 rotates in each process unit 21. Then, a high-speed scanning is carried out exposing the surface of the photosensitive drum 22 to the laser beam emitted from the exposing unit 29. As a result, an electrostatic latent image corresponding to an image to be formed on the sheet 99 is formed on the surface of the photosensitive drum 22. Then, the toner storage unit 26 and the developing roller 23 supply the toner onto the surface of the photosensitive drum 22. As a result, a toner image corresponding to the electrostatic latent image is formed on the surface of the photosensitive drum 22.

Then, as the sheet 99 passed over the transfer plane 40A, the toner image carried on the surface of the photosensitive drum 22 of each process unit 21 is transferred onto the one surface 99A of the sheet 99 due to negative charge applied to each transfer roller 43. Then, the sheet 99 is heated and pressurized in the fixing unit 30. As a result, the transferred toner image is fixed onto the sheet 99.

The first discharge rollers 31 and 32 are disposed behind and above the fixing unit 30. The first discharge rollers 31 and 32 confront each other with the first conveyance path P1 interposed therebetween. The first discharge roller 31 is controlled by the control unit (not shown), and rotates positively or negatively. The first discharge roller 32 is pressed against the first discharge roller 31, and rotates along with the rotation of the first discharge roller 31.

The second discharge rollers 33 and 34 are disposed above and ahead of the first discharge rollers 31 and 32. The second discharge rollers 33 and 34 are provided so that the second discharge rollers 33 and 34 confront the discharge tray 2C. The second discharge rollers 33 and 34 confront each other with the first conveyance path P1 interposed therebetween. The second discharge roller 33 is controlled by the control unit (not shown), and rotates positively or negatively in synchronization with the first discharge roller 31. The second discharge roller 34 is pressed against the second discharge roller 33, and rotates along with the rotation of the second discharge roller 33.

The first discharge rollers 31 and 32 and the second discharge rollers 33 and 34 nip a sheet 99 that has passed through the fixing unit 30. The sheet 99 is discharged onto the discharge tray 2C as the first discharge roller 31 and the second discharge roller 33 rotate positively.

The flapper 49 is provided on the first conveyance path P1 between the fixing unit 30 and the first discharge rollers 31 and 32. The lower end of the flapper 49 is swingably supported by a frame member 2F. The flapper 49 can swing between a position indicated by a solid line in FIG. 1 and a position indicated by a two-dot chain line in FIG. 1.

A spring (not shown) is provided between the flapper 49 and the frame member 2F. The spring urges the flapper 49 so as to keep the flapper 49 at the position indicated by the two-dot chain line in FIG. 1. The urging force of the spring is weak enough that the flapper 49 can swing from the position indicated by the two-dot chain line in FIG. 1 to the position indicated by the solid line in FIG. 1 when coming in contact with the sheet 99 being conveyed on the first conveyance path P1.

The flapper 49 does not block a sheet 99 being conveyed along the first conveyance path P1 at the position indicated by the solid line in FIG. 1, whereas the flapper 49 crosses over the first conveyance path P1 at the position indicated by the two-dot chain line in FIG. 1. Thus, the flapper 49 guides a sheet 99 to the second conveyance path P2 when the sheet 99 is conveyed.

The above-described first discharge rollers 31 and 32, second discharge rollers 33 and 34, discharge sensor 44, and flapper 49 are equipped with a mechanism for reversing a sheet 99. The sheet 99, on whose one surface 99A an image has been formed, is reversed in the following manner.

Figure 2:
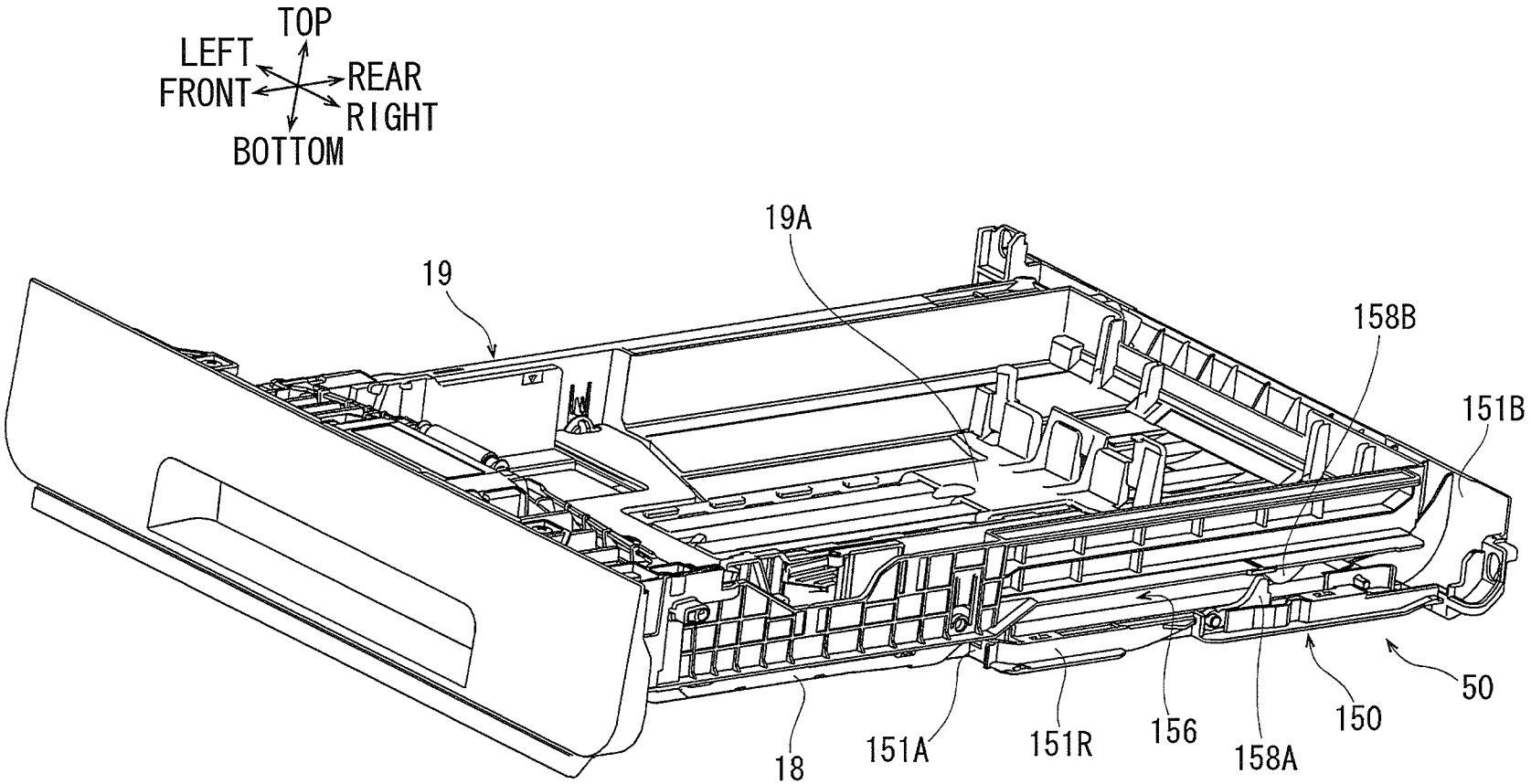
FIG. 2 is a perspective view of a sheet tray housed into a housing and a conveying unit that are extracted from the image forming device according to the first embodiment.
Figure 3:
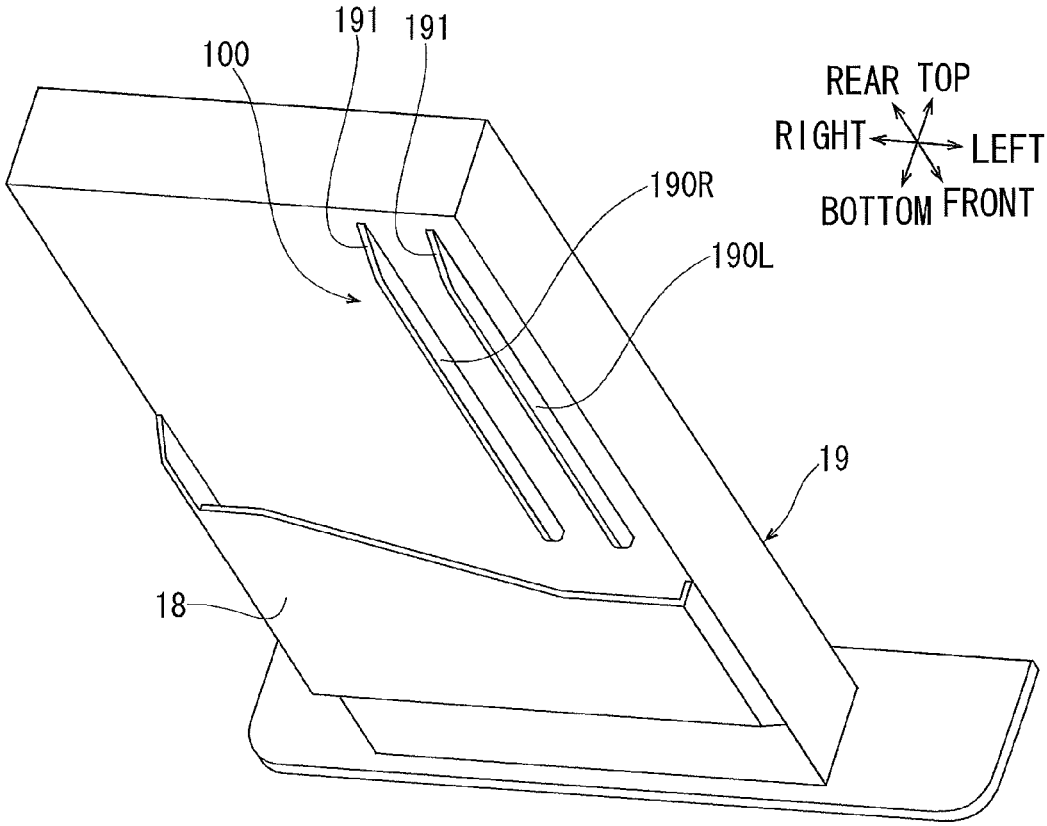
FIG. 3 is a perspective view mainly illustrating the bottom surface of the sheet tray of the image forming device according to the first embodiment.

As the first discharge rollers 31 and 32 hold one portion of the sheet 99 and the second discharge rollers 33 and 34 hold another portion of the sheet 99, the sheet 99 is conveyed to the discharge tray 2C. In the conveyance process of the sheet 99 to the discharge tray 2C, the discharge sensor 44 discontinues the detection of the rear edge of the sheet 99. The control unit (not shown) stops the rotation of the first discharge roller 31 and the second discharge roller 33 and starts the negative rotation of the first discharge roller 31 and the second discharge roller 33 at a predetermined timing after the discontinuation of the detection by the discharge sensor 44. The timing is so set as to come after the flapper 49, urged by the spring (not shown), has returned to the position indicated by the two-dot chain line in FIG. 1 as the rear edge of the sheet 99 passes over the flapper 49. Consequently, the upper end of the flapper 49 crosses over the first conveyance path P1, and extends along the second conveyance path P2. As a result, the sheet 99 is fed to the second conveyance path P2 by the first discharge rollers 31 and 32, the second discharge rollers 33 and 34, and the flapper 49. Then, the sheet 99 is conveyed, downward on the second conveyance path P2, and reaches the conveying unit 50 that is disposed below the sheet tray 19, as shown in FIGS. 1 and 2. In the situation shown in FIG. 2, the rear side of the bottom surface of the sheet tray 19 shown in FIG. 3 is put over the conveying unit 50 shown in FIG. 4.

As shown in FIG. 1, the conveying unit 50 includes drive rollers 111, 121 and 131 and pinch rollers 112, 122 and 132. The drive rollers 111, 121 and 131 are examples of a first roller of the present invention. The pinch rollers 112, 122 and 132 are examples of a second roller of the present invention.

The drive roller 111 and the pinch roller 112 are disposed on the lower side of the rear end of the sheet tray 19. The drive roller 111 and the pinch roller 112 confront each other in a vertical direction with the general horizontal portion of the second conveyance path P2 interposed therebetween. The drive roller 121 and the pinch roller 122 are disposed on the lower side of the general middle portion of the sheet tray 19 in the front-rear direction. The drive roller 121 and the pinch roller 122 confront each other in the vertical direction with the general horizontal portion of the second conveyance path P2 interposed therebetween. The drive roller 131 and the pinch roller 132 are disposed on the lower side of the general middle portion of the sheet tray 19 in the front-rear direction and on the front side of the drive roller 121 and the pinch roller 122. The drive roller 131 and the pinch roller 132 confront each other in the vertical direction with the general horizontal portion of the second conveyance path P2 interposed therebetween. The vertical direction is an example of a third direction of the present invention.

The drive rollers 111, 121 and 131 and the pinch rollers 112, 122 and 132 are disposed so as to overlap with the sheet tray 19 in the vertical direction that is a direction perpendicular to the sheet placement surface 19A. The drive rollers 111, 121 and 131 and the pinch rollers 112, 122 and 132 are disposed on the opposite side of the sheet tray 19 with the image-forming unit 20 intervened therebetween.

After a sheet 99 is conveyed on the second conveyance path P2 and reaches the conveying unit 50, the one surface 99A of the sheet 99 faces upward and the sheet 99 is held between the drive roller 11 and the pinch roller 112. After that, the sheet 99 is held between the drive roller 121 and the pinch roller 122, and then between the drive roller 131 and the pinch roller 132, as the sheet 99 is conveyed to the front side. Then, the sheet 99 is put onto the first conveyance path P1. Accordingly, the sheet 99 is conveyed again on the first conveyance path P1 by the conveyance rollers 14 and 15 and the registration rollers 16 and 17, and passes through the image-forming unit 20 and the fixing unit 30 with the other surface 99B thereof facing upward. As a result, an image is also formed on the other surface 99B of the sheet 99. With the images formed on both sides of the sheet 99, the sheet 99 is discharged by the first discharge rollers 31 and 32 and the second discharge rollers 33 and 34 onto the discharge tray 2C.

As shown in FIGS. 4 through 9, the conveying unit 50 includes a support member 150 and an opposing member 156.

As shown in FIG. 1, the support member 150 is disposed below the second conveyance path P2. As shown in FIGS. 4 through 9, the support member 150 includes a bottom wall 151 and a plurality of guide ribs 152.

The bottom wall 151 is a member formed of a resin material, and is in a general plate-like shape extending in the front-rear and left-right directions. The bottom wall 151 has a right-left dimension greater than the width of the sheet 99. A rear end 151B of the bottom wall 151 is curved in such a way as to rise in an upper rear direction.

Each guide rib 152 is formed so as to protrude upward from the bottom wall 151. The guide ribs 152 are arranged at intervals in the left-right direction. The guide ribs 152 each extend in the front-rear direction, that is, in the direction in which the sheet 99 is conveyed. The support member 150 guides a sheet 99 being conveyed downward on the second conveyance path P2 with the help of the curved rear end 151B, and changes the conveyance direction of the sheet 99 in such a way that the sheet 99 passes along the general horizontal portion of the second conveyance path P2 with the help of the upper edge of each of the guide ribs 152.

As shown in FIGS. 1 through 3, a conveyance guide section 18 is formed on the front side of the bottom surface of the sheet tray 19. The rear end of the conveyance guide section 18 is in contact with a front end 151A of the bottom wall 151 when the sheet tray 19 is mounted in the housing 2. The conveyance guide section 18 guides a sheet 99 in such a way as to take over from the guidance of the support member 150 and put it onto the first conveyance path P1.

As shown in FIGS. 4 through 6, 8 and 9, the opposing member 156 is disposed above the support member 150 with a space provided therebetween. The opposing member 156 is a sheet-metal processed member, and is formed in a general plate-like shape extending in the front-rear and left-right directions. The opposing member 156 opposes to the bottom wall 151 of the support member 150 in the vertical direction. A right end 156R of the opposing member 156 is bent downward, and is swingably held about a swing axis X156 extending in the front-rear direction along a right end 151R of the bottom wall 151. The opposing member 156 swings about the swing axis X156 due to a warp of the right end 151R thereof.

As shown in FIGS. 5, 6, 8 and 9, three guide holes 181A, 182A and 183A are formed on a left end 156L of the opposing member 156 and arranged in the front-rear direction. The guide holes 181A, 182A and 183A are circular holes. The left end 156L is bent downward at the corner of the front end thereof, and the front-side guide hole 183A is formed at the corner of the front end.

As shown in FIGS. 4 through 6 and 8, a positioning hole 184A is formed behind the guide hole 181A located on the rear side of the left end 156L of the opposing member 156. The positioning hole 184A is an elongate hole that is elongated in the front-rear direction. A positioning hole 185A is formed slightly ahead of the guide hole 182A located at the middle portion of the left end 156L of the opposing member 156 in the front-rear direction. The positioning hole 185A is a circular hole.

As shown in FIGS. 6 through 9, bosses 181B, 182B and 183B are formed on a left end 151L of the bottom wall 151 in the support member 150 and arranged in the front-rear direction. The bosses 181B, 182B and 183B each are formed so as to protrude upward in a cylindrical shape.

Figure 5:
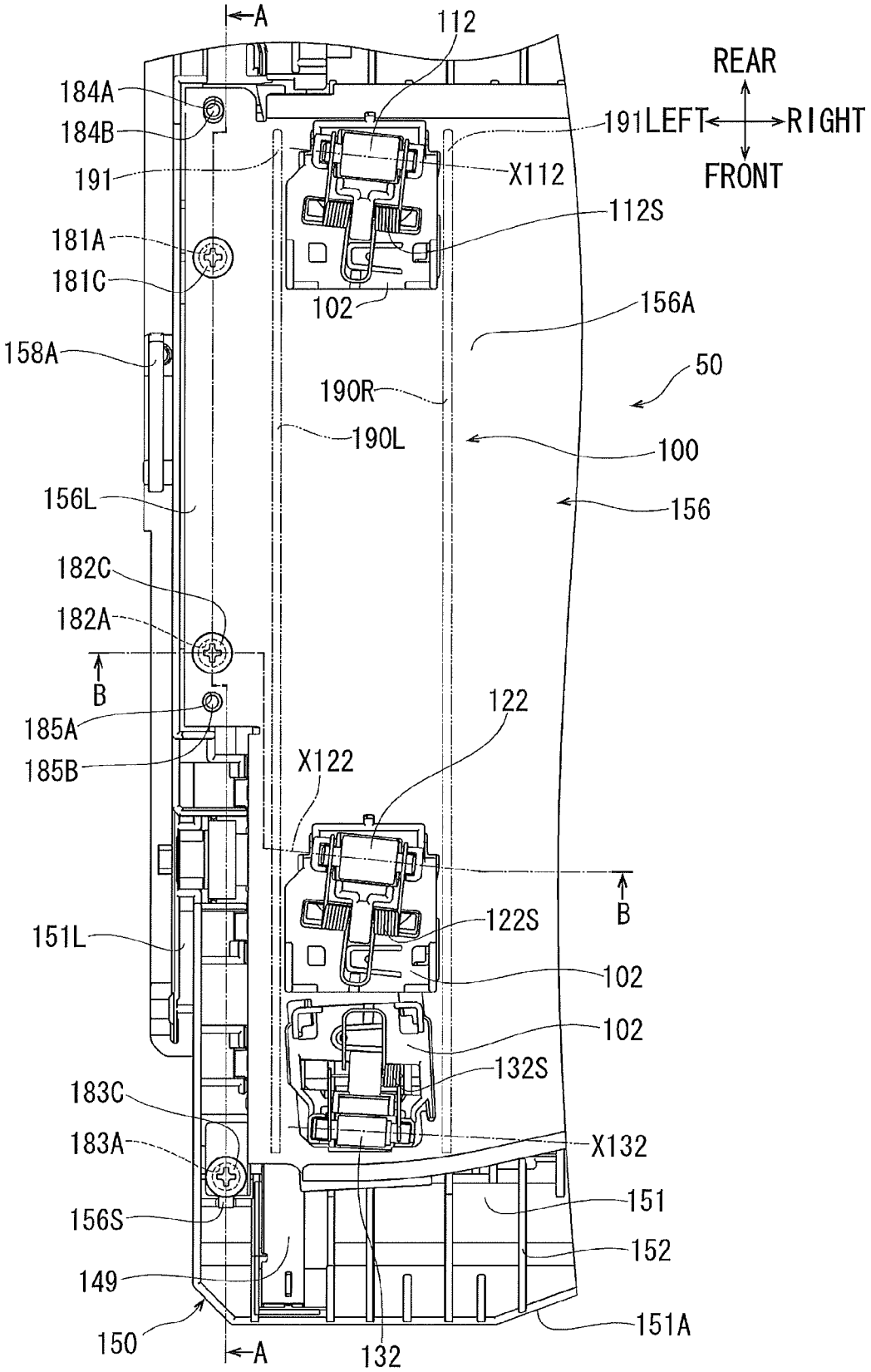
FIG. 5 is a partial top view of the conveying unit of the image forming device according to the first embodiment.
Figure 7A:
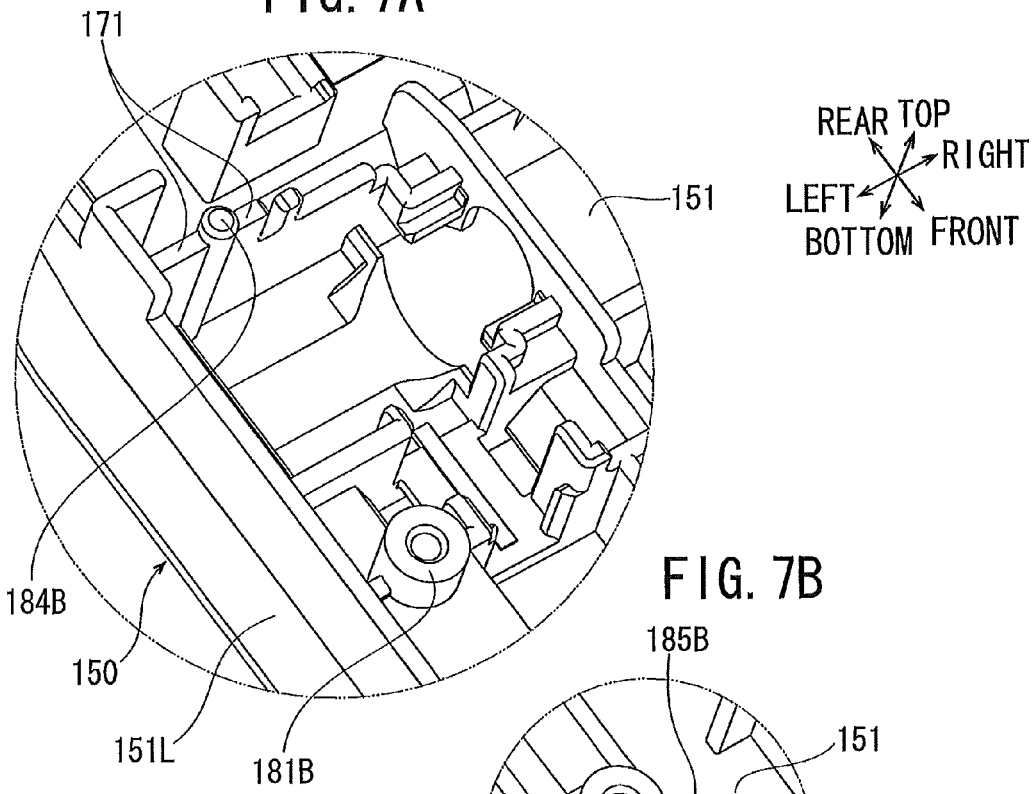
FIG. 7A is a partial perspective view of the conveying unit of the image forming device according to the first embodiment viewed in a direction indicated by an arrow C shown in FIG. 6.
Figure 7B:
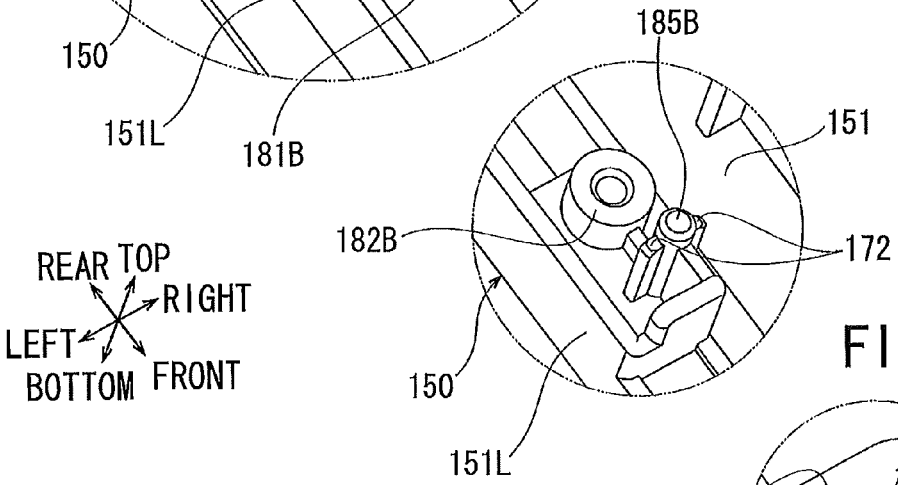
FIG. 7B is a partial perspective view of the conveying unit of the image forming device according to the first embodiment viewed in a direction indicated by an arrow D shown in FIG. 6.
Figure 7C:
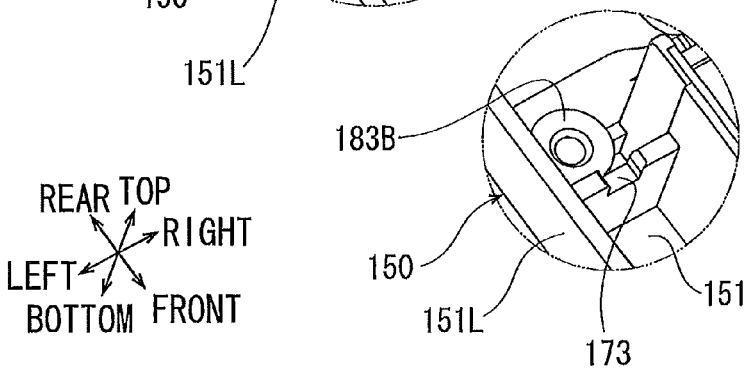
FIG. 7C is a partial perspective view of the conveying unit of the image forming device according to the first embodiment viewed in a direction indicated by an arrow E shown in FIG. 6.

As shown in FIGS. 5, 7 and 8, a positioning convex section 184B is formed behind the boss 181B located on the rear side of the left end 151L of the bottom wall 151. The positioning convex section 184B is a cylindrical axis body protruding upward. A positioning convex section 185B is formed slightly ahead of the boss 182B located at the middle portion of the left end 151L of the bottom wall 151 in the front-rear direction. The positioning convex section 185B is a cylindrical axis body protruding upward.

Figure 6:
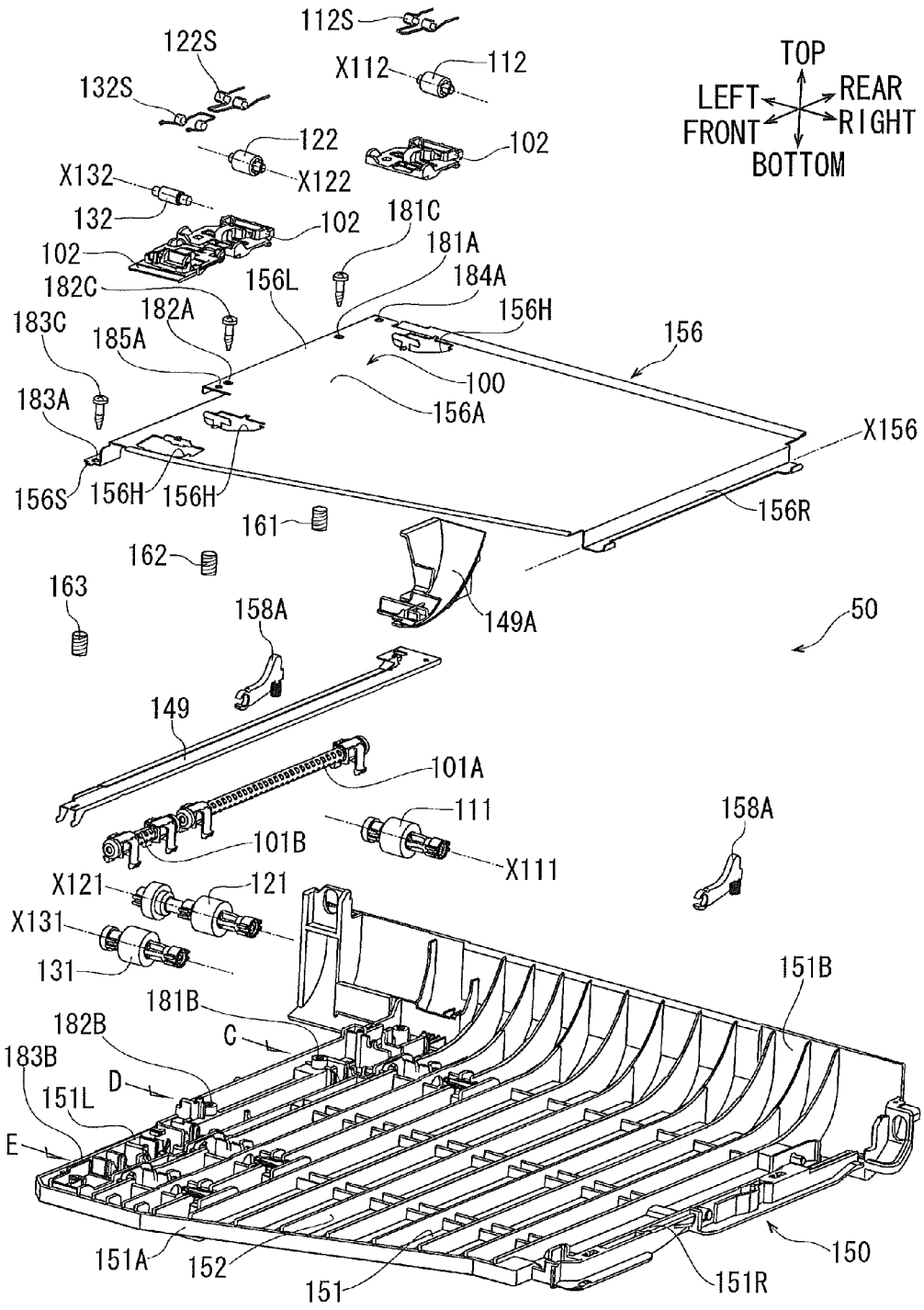
FIG. 6 is an exploded perspective view of the conveying unit of the image forming device according to the first embodiment.

As shown in FIGS. 4 through 8, a guide shaft 181C is screwed into the boss 181B located on the rear side of the left end 151L from above. The guide shaft 181C is inserted into the guide hole 181A of the opposing member 156. As shown in FIGS. 6 and 8, the guide shaft 181C is inserted into a compression coil spring 161. The compression coil spring 161 is disposed so as to be compressed between the opposing member 156 and the boss 181B.

As shown in FIGS. 4 through 9, a guide shaft 182C is screwed into the boss 182B located at the middle portion of the left end 151L in the front-rear direction from above. The guide shaft 182C is inserted into the guide hole 182A of the opposing member 156. As shown in FIGS. 6, 8 and 9, the guide shaft 182C is inserted into a compression coil spring 162. The compression coil spring 162 is disposed so as to be compressed between the opposing member 156 and the boss 182B.

As shown in FIGS. 4 through 8, a guide shaft 183C is screwed into the boss 183B located on the front side of the left end 151L from above. The guide shaft 183C is inserted into the guide hole 183A of the opposing member 156. As shown in FIGS. 6 and 8, the guide shaft 183C is inserted into a compression coil spring 163. The compression coil spring 163 is disposed so as to be compressed between the opposing member 156 and the boss 183B.

As shown in FIGS. 7 and 8, an upper edge of a rib joined to the outer peripheral surface of the positioning convex section 184B in the bottom wall 151 serves as a contact section 171. The contact section 171 extends in the horizontal direction below the positioning convex section 184B. An upper edge of a rib joined to the outer peripheral surface of the positioning convex section 185B in the bottom wall 151 serves as a contact section 172. The contact section 172 extends in the horizontal direction below the positioning convex section 185B. A concave section is formed on an upper edge of a rib that extends on the front side of the boss 183B in the left-right direction, and a bottom surface of the concave section serves as a contact section 173.

The left end 156L of the opposing member 156 swings about the right end 156R in the vertical direction as the compression coil springs 161, 162 and 163 expand and contract. The vertical direction is an example of a first direction of the present invention.

Figure 8A:
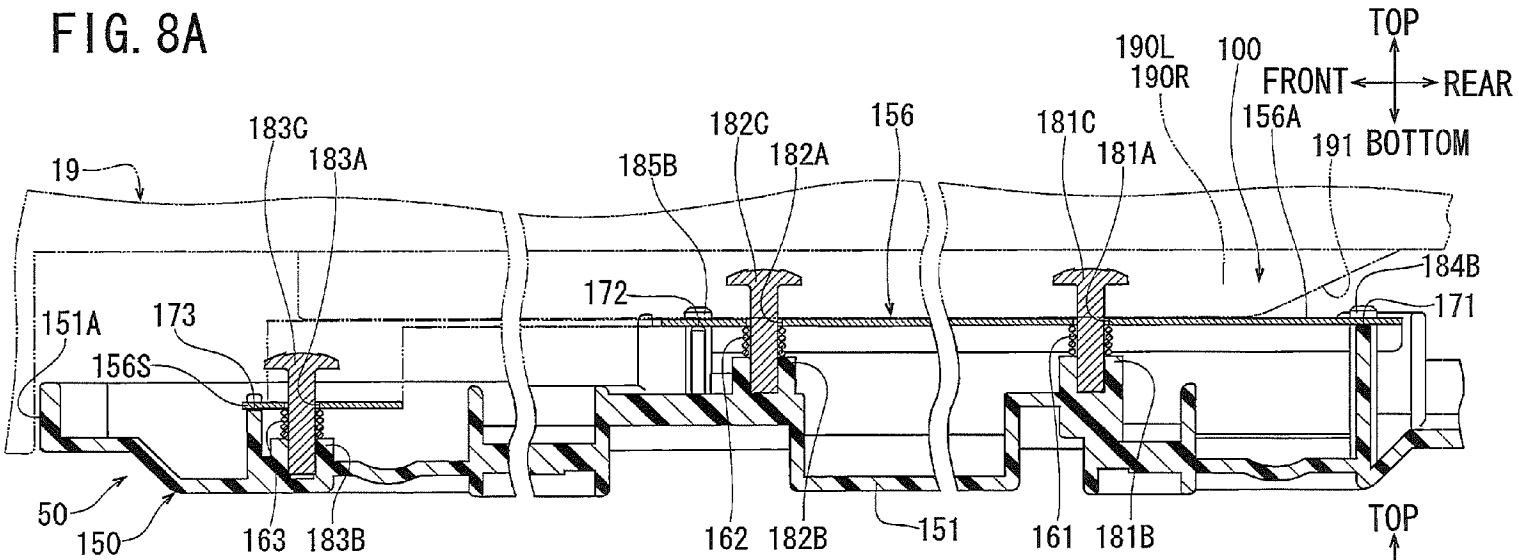
FIG. 8A is a schematic cross-sectional view illustrating the conveying unit of the image forming device according to the first embodiment taken along a plane A-A shown in FIG. 5.
Figure 9A:
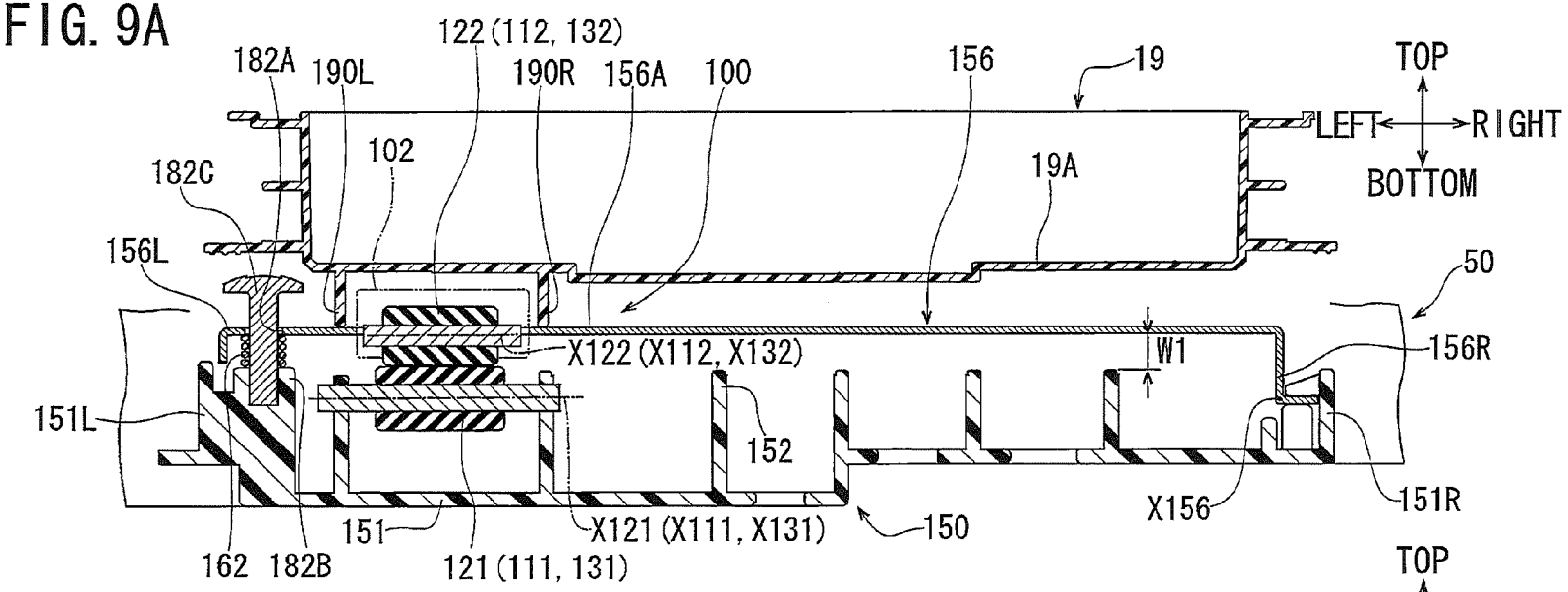
FIG. 9A is a schematic cross-sectional view illustrating the conveying unit of the image forming device according to the first embodiment taken along a plane B-B shown in FIG. 5.

More specifically, as shown in FIGS. 8A and 9A, when pressing sections 190L and 190R (described later) press an upper surface 156A of the opposing member 156 and the compression coil springs 161, 162 and 163 thereby contract, the opposing member 156 approaches the support member 150. At this time, the contact section 171 comes in contact with the rear side of the left end 156L from the lower side, the contact section 172 comes in contact with the middle portion of the left end 156L in the front-rear direction from the lower side, and the contact section 173 comes in contact with a small piece 156S, which protrudes to the front side from the corner of the front end of the left end 156L, from the lower side, as shown in FIG. 8A. As a result, the opposing member 156 confronts the support member 150 in a horizontal state, as shown in FIG. 9A, and the distance W1 between the opposing member 156 and the support member 150 is kept at a certain level. Moreover, at this time, the positioning convex section 184B is fitted into the positioning hole 184A, and the positioning convex section 185B is fitted into the positioning hole 185A, as shown in FIG. 5. As a result, the position of the opposing member 156 in the front-rear direction and the left-right direction is determined relative to the support member 150.

Figure 8B:
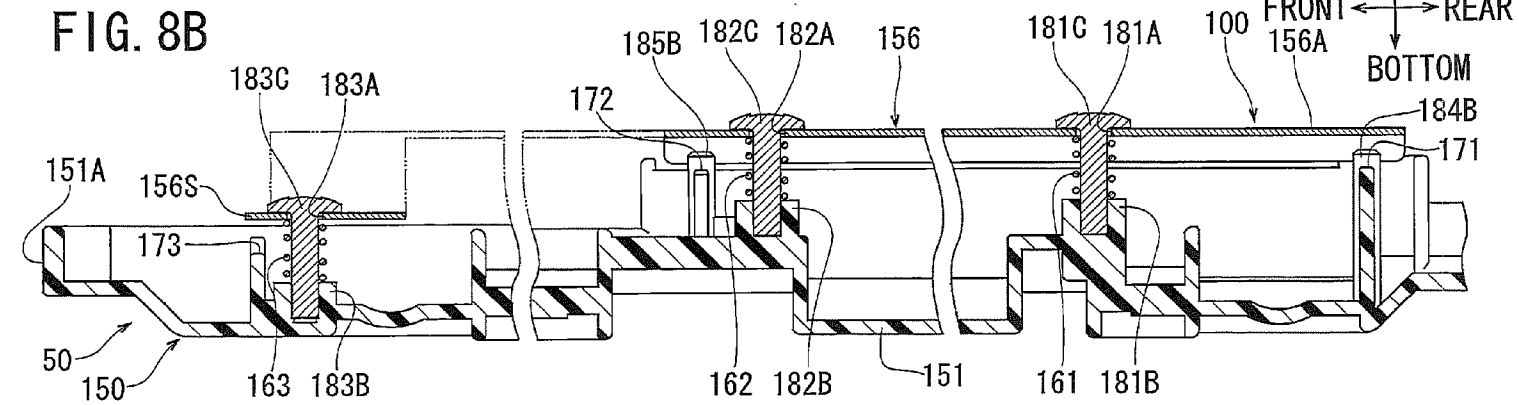
FIG. 8B is a schematic cross-sectional view illustrating the conveying unit of the image forming device according to the first embodiment taken along a plane A-A shown in FIG. 5.
Figure 9B:
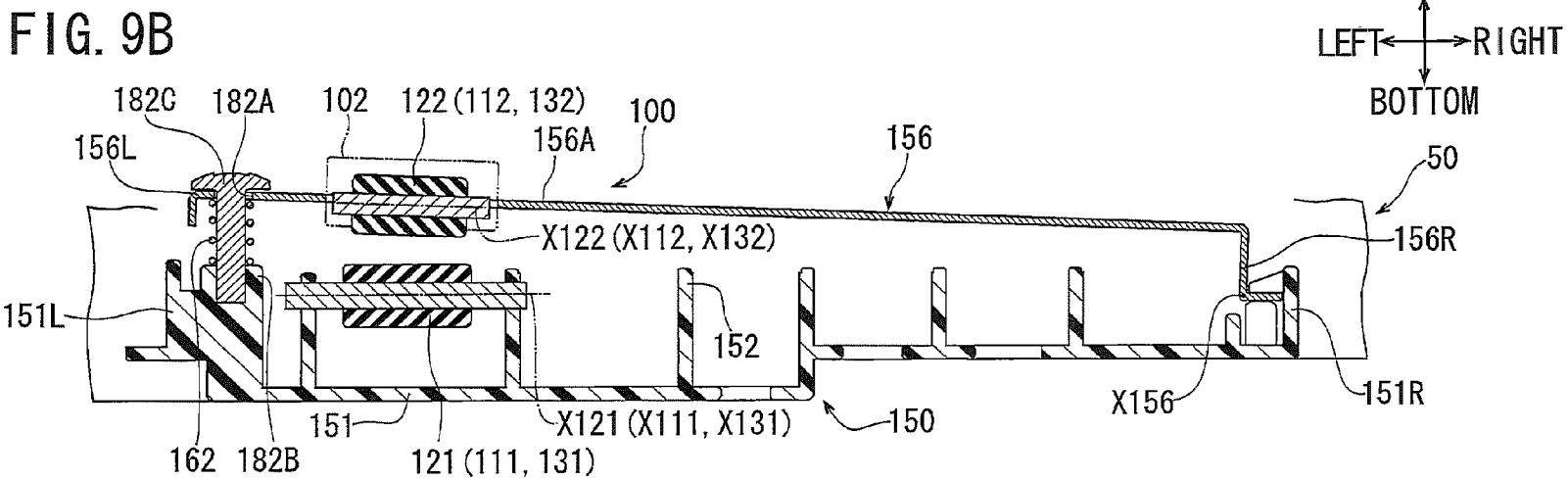
FIG. 9B is a schematic cross-sectional view illustrating the conveying unit of the image forming device according to the first embodiment taken along a plane B-B shown in FIG. 5.

On the other hand, as shown in FIGS. 8B and 9B, when the pressing sections 190L and 190R stop pressing the upper surface 156A of the opposing member 156 and the compression coil springs 161, 162 and 163 thereby expand, the left end 156L hits the heads of the guide shafts 181C, 182C and 183C and is stopped. As a result, the opposing member 156 becomes inclined, and is separated upward from the support member 150.

Figure 4:
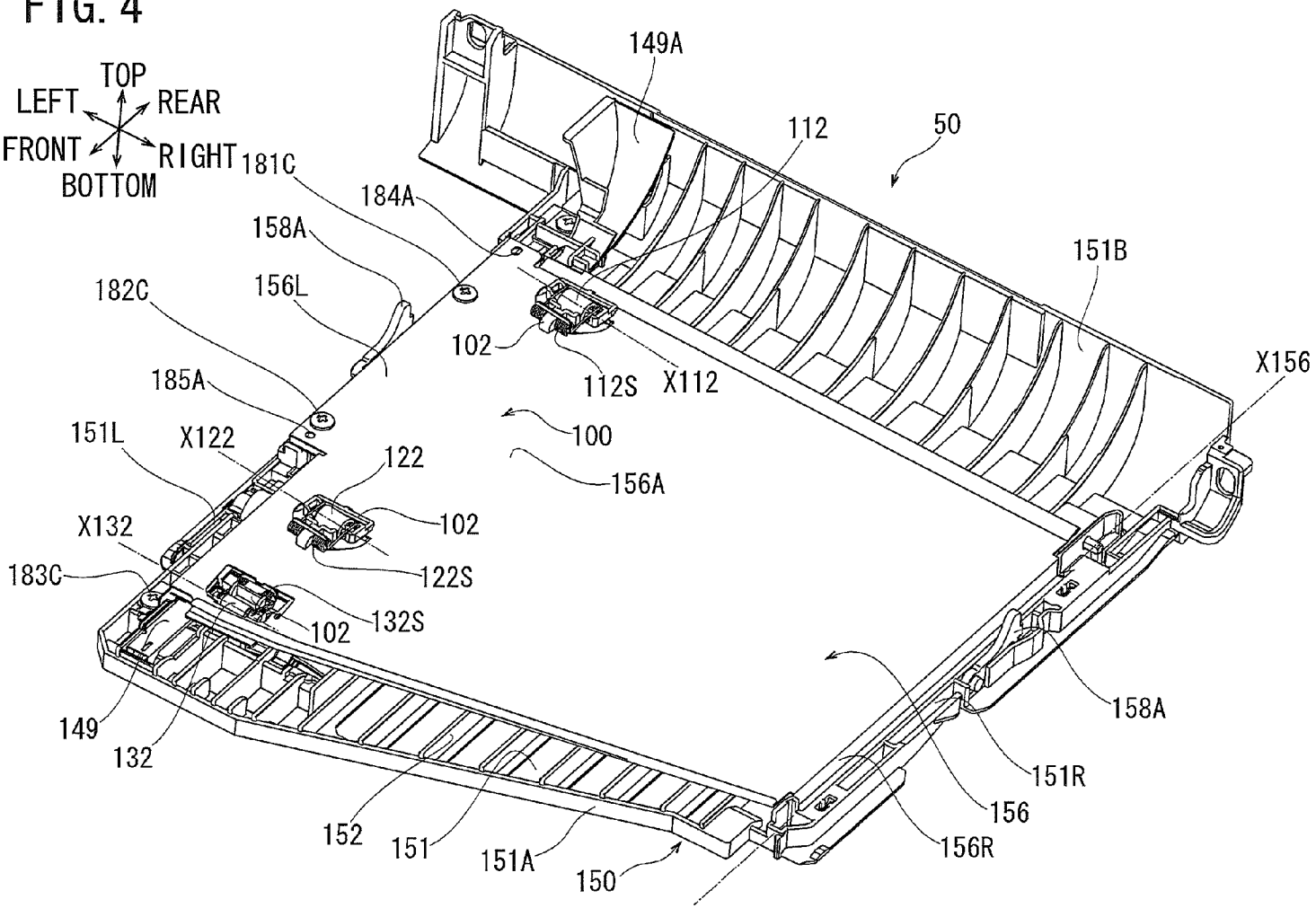
FIG. 4 is a perspective view of the conveying unit of the image forming device according to the first embodiment.

As shown in FIGS. 4 through 6, the conveying unit 50 includes a one-side regulating member 149. The one-side regulating member 149 is mounted on the left end 151L of the bottom wall 151. The one-side regulating member 149 extends in the front-rear direction, and is provided contactably with the left edge of a sheet 99 that is conveyed. The one-side regulating member 149 carries out a positioning of the conveyed sheet 99 in the left-right direction. A one-side guide section 149A is connected to the rear end of the one-side regulating member 149. The one-side guide section 149A guides the sheet 99 straying toward the left side from the one-side regulating member 149 so that the sheet 99 moves along the one-side regulating member 149.

As shown in FIGS. 6 and 9, the drive rollers 111, 121 and 131 are disposed so as to be close to the left end 151L of the bottom wall 151. The support member 150 supports the drive roller 111 so as to be capable of rotating about a first rotation shaft X111 extending in the left-right direction. The support member 150 also supports the drive roller 121 so as to be capable of rotating about a first rotation shaft X121 extending in the left-right direction. The support member 150 further supports the drive roller 131 so as to be capable of rotating about a first rotation shaft X131 extending in the left-right direction. The positions of the first rotation shafts X111, X121 and X131 are fixed relative to the support member 150.

As shown in FIG. 6, the drive rollers 111, 121 and 131 are connected to each other via two drive force transmission members 101A and 101B. The drive force transmission members 101A and 101B include shafts and gears. A drive source, such as a motor (not shown) provided in the housing 2, is connected to the drive roller 121 via a plurality of gears. Therefore, the drive rollers 111, 121 and 131 are driven to rotate by the drive source (not shown) in synchronization with each other.

Three mounting holes 156H are formed on the left end 156L of the opposing member 156 and arranged in the front-rear direction. The mounting holes 156H each are placed at locations corresponding to the drive rollers 111, 121 and 131. A roller holder 102 is mounted in each mounting hole 156H.

As shown in FIGS. 4 through 6 and 9, the opposing member 156 supports the rear-side pinch roller 112 so as to be capable of rotating about a second rotation shaft X112 through the rear-side roller holder 102. The opposing member 156 supports the middle-portion pinch roller 122 so as to be capable of rotating about a second rotation shaft X122 through the middle-portion roller holder 102. The opposing member 156 supports the front-side pinch roller 132 so as to be capable of rotating about a second rotation shaft X132 through the front-side roller holder 102. As shown in FIG. 5, the second rotation shafts X112, X122 and X132 are slightly tilted with respect to the left-right direction in such a way that the left end surfaces of the pinch rollers 112, 122 and 132 are closer to the rear side than the right end surfaces of the pinch rollers 112, 122 and 132 are.

The roller holders 102 each allow the motion of the pinch rollers 112, 122 and 132 in the vertical direction. As shown in FIGS. 5 and 6, torsion coil springs 112S, 122S and 132S are provided in the roller holders 102. The torsion coil springs 112S, 122S and 132S urge the corresponding pinch rollers 112, 122 and 132 downward. Therefore, the second rotation shafts X112, X122 and X132 are movable in the vertical direction relative to the support member 150 and the first rotation shafts X111, X121 and X131. The nip pressures between the drive rollers 111, 121 and 131 and the pinch rollers 112, 122 and 132 are set appropriately due to the urging force of the torsion coil springs 111, 121 and 131 and pinch rollers 112, 122 and 132.

As shown in FIG. 3, pressing sections 190L and 190R are provided on the rear side of the bottom surface of the sheet tray 19. The pressing sections 190L and 190R are formed integrally with the sheet tray 19 that is formed of a resin material. The pressing sections 190L and 190R have the same shape, and are different only in terms of their located positions. The left-side pressing section 190L extends in the front-rear direction from the middle portion of the bottom surface of the sheet tray 19 to the rear end. The left-side pressing section 190L is located on the left edge of the bottom surface of the sheet tray 19. The right-side pressing section 190R is separated from the left-side pressing section 190L toward the right side, and extends in the front-rear direction parallel to the left-side pressing section 190L.

The lower edges of the pressing sections 190L and 190R extend horizontally in the front-rear direction. Inclined portions 191 are formed in the rear end of the pressing sections 190L and 190R. The inclined portions 191 are inclined in such a way as to rise toward the rear side. That is, the inclined portions 191 are inclined in the front-rear direction that is the attaching-and-detaching direction.

A switching mechanism 100 includes the pressing sections 190L and 190R, the opposing member 156, the upper surface 156A of the opposing member 156, the compression coil springs 161, 162 and 163, and the contact sections 171, 172 and 173. The pressing sections 190L and 190R are formed on the bottom surface of the sheet tray 19. The opposing member 156 moves toward or away from the support member 150. The upper surface 156A of the opposing member 156 is pressed by the pressing sections 190L and 190R. The compression coil springs 161, 162 and 163 are provided between the support member 150 and the opposing member 156. The contact sections 171, 172 and 173 are provided in the support member 150. The upper surface 156A of the opposing member 156 is an example of a pressed section of the present invention. The compression coil springs 161, 162 and 163 are examples of an urging section of the present invention.

As shown in FIGS. 2 and 4 through 6, a matched pair of lock levers 158A is provided in the left end 151L and the right end 151R of the bottom wall 151 in the support member 150. The two lock levers 158A are swingably supported by the left end 151L and the right end 151R. The two lock levers 158A are urged by urging springs (not shown) so as to swing upward.

As shown in FIG. 2, a pair of engagement sections 158B is provided on the left-side surface and right-side surface of the sheet tray 19. The configuration of the left-side engagement section 158B is identical to that of the right-side engagement section 158B, and is therefore not shown in the drawings. The two engagement sections 158B protrude downward.

As shown in FIG. 2, during the loading operation of the sheet tray 19, the two engagement sections 158B come in contact with the two lock levers 158A, and push down the two lock levers 158A when passing over the two lock levers 158A. After that, the two lock levers 158A are pressed upward by the urging springs (not shown), and thereby keep the two engagement sections 158B from moving toward the front side. As a result, the sheet tray 19 is locked so as not to move in the attaching-and-detaching direction after the loading operation of the sheet tray 19 is completed.

In the image forming device 1 according to the preferred embodiment, as the sheet tray 19 is attached to the housing 2, the switching mechanism 100 causes the drive roller 111 to come in contact with the pinch roller 112, the drive roller 121 to come in contact with the pinch roller 122, and the drive roller 131 to come in contact with the pinch roller 132, as described below.

That is, as shown in FIGS. 5, 8A and 9A, as the sheet tray 19 is attached to the housing 2, the pressing sections 190L and 190R come in contact with the upper surface 156A of the opposing member 156 on the left side and the right side of the pinch rollers 111, 121 and 131, thereby pressing the upper surface 156A downward. In the early stage of the loading operation, the inclined portions 191 gradually push down the opposing member 156 as the inclined portions 191 slidingly contact with the upper surface 156A of the opposing member 156. After that, the horizontal lower edges of the pressing sections 190L and 190R slidingly contact with the upper surface 156A of the opposing member 156, and evenly press the entire opposing member 156.

As a result, the compression coil springs 161, 162 and 163 contract, and the opposing member 156 opposes the support member 150 in a horizontal state. At this time, the contact sections 171, 172 and 173 keep the distance W1 between the opposing member 156 and the support member 150 at a constant level. As a result, the drive roller 111 comes in contact with the pinch roller 112, and the nip pressure between the drive roller 111 and pinch roller 112 is set appropriately by the torsion coil spring 112S. Moreover, the drive roller 121 comes in contact with the pinch roller 122, and the nip pressure between the drive roller 121 and pinch roller 122 is set appropriately by the torsion spring 122S. Furthermore, the drive roller 131 comes in contact with the pinch roller 132, and the nip pressure between the drive roller 131 and pinch roller 132 is set appropriately by the torsion coil spring 132S. Accordingly, the drive rollers 111, 121 and 131 and the pinch rollers 112, 122 and 132 can hold the sheet 99 that is conveyed again after an image is formed by the image-forming unit 20. Therefore, the conveyed sheet 99 can be held and conveyed properly with an appropriate nip pressure.

Meanwhile, as the sheet tray 19 is detached from the housing 2, the switching mechanism 100 separates the drive roller 111 and the pinch roller 112, the drive roller 121 and the pinch roller 122, and the drive roller 131 and the pinch roller 132, as described below.

That is, as shown in FIGS. 4, 8B and 9B, when the sheet tray 19 is detached from the housing 2, the pressing sections 190L and 190R move away toward the front side of the opposing member 156 as the pressing sections 190L and 190R slidingly contact with the upper surface 156A of the opposing member 156. In the final stage of the detaching operation, the inclined portions 191 move away toward the front side of the opposing member 156 as the inclined portions 191 slidingly contact with the upper surface 156A of the opposing member 156. Therefore, the compression coil springs 161, 162 and 163 gradually push up the opposing member 156. After the sheet tray 19 is completely detached, the compression coil springs 161, 162 and 163 evenly lift up the entire opposing member 156, and the opposing member 156 is thereby separated upward from the support member 150.

As a result, the pinch roller 112 moves upward away from the drive roller 111, the pinch roller 122 moves upward away from the drive roller 121, and the pinch roller 132 moves upward away from the drive roller 131. Therefore, with the image forming device 1, when a sheet 99 is jammed in the conveying unit 50, the drive rollers 111, 121 and 131 and the pinch rollers 112, 122 and 132 do not keep holding the jammed sheet 99 therebetween. Thus, the sheet 99 does not tear even if a user holds the sheet 99 with his/her fingers putted into the image forming device 1 and forcibly pulls it out.

Therefore, with the image forming device 1 according to the preferred embodiment, the sheet jammed in the conveying unit 50 can be easily removed.

Moreover, with the image forming device 1, the switching mechanism 100 only allows the pinch rollers 112, 122 and 132 to move in the vertical direction, and does not allow the drive rollers 111, 121 and 131 to move, in conjunction with the loading operation of the sheet tray into the housing 2 and the detaching operation of the sheet tray 19 from the housing 2. Therefore, with the image forming device 1, the conveying unit 50 and the switching mechanism 100 can be simplified compared with a case where the switching mechanism 100 is designed to allow both the drive rollers 111, 121 and 131 and the pinch rollers 112, 122 and 132 to move.

Furthermore, with the image forming device 1, the pressing sections 190L and 190R press the upper surface 156A of the opposing member 156 toward the support member 150, thereby taking the opposing member 156 closer to the support member 150 and indirectly pressing the pinch rollers 112, 122 and 132 against the drive rollers 111, 121 and 131. Therefore, with the image forming device 1, the second conveyance path P2 can be easily formed to guide the conveyed sheet 99 between the support member 150 and the opposing member 156.

Moreover, in the image forming device 1, the inclined portions 191 are inclined in the attaching-and-detaching direction that is substantially parallel to the sheet placement surface 19A and in the front-rear direction. During the loading operation, the inclined portions 191 bring the opposing member 156 closer to the support member 150 as the inclined portions 191 slidingly contact with the upper surface 156A of the opposing member 156. Accordingly, the image forming device 1 can certainly press the pinch rollers 112, 122 and 132 against the drive rollers 11, 121 and 131 by employing such simple inclined portions 191.

Furthermore, with the image forming device 1, when the pressing sections 190L and 190R stop pressing the upper surface 156A of the opposing member 156 in conjunction with the unloading operation of the sheet tray 19, the compression coil springs 161, 162 and 163 urge the opposing member 156, thereby separating the opposing member 156 upward from the support member 150. Accordingly, the image forming device 1 can certainly separate the drive rollers 111, 121 and 131 from the pinch rollers 112, 122 and 132 by employing such simple compression coil springs 161, 162 and 163.

In the image forming device 1, the contact sections 171, 172 and 173 keep the distance W1 between the opposing member 156 and the support member 150 at a constant level, thereby helping indirectly to keep the distance W1 between the drive rollers 111, 121 and 131 and the pinch rollers 112, 122 and 132 at a constant level. Therefore, the nip pressure for holding a sheet 99 between the drive rollers 111, 121 and 131 and the pinch rollers 112, 122 and 132 can be appropriately maintained.

Furthermore, in the image forming device 1, the drive rollers 111, 121 and 131 and the pinch rollers 112, 122 and 132 are disposed so as to overlap with the sheet tray 19 in the vertical direction that is perpendicular to the sheet placement surface 19A. Therefore, with the image forming device 1, the device can be made smaller in size, because the second conveyance path P2 is disposed parallel to the sheet tray 19.

In the image forming device 1, the drive rollers 111, 121 and 131 and the pinch rollers 112, 122 and 132 are placed on the opposite side of the image-forming unit 20 with the sheet tray 19 intervened therebetween. Therefore, in the image forming device 1, the second conveyance path P2 is located on the lower side of the sheet tray 19, and the upper side of the conveying unit 50 is opened widely after the sheet tray 19 is detached from the housing 2. As a result, the image forming device 1 allows a user to put his/her hand into the opened space and remove the sheet 99 jammed in the conveying unit 50 more easily.

Next, a second embodiment of the present invention will be described with reference to FIGS. 10 and 11, wherein like parts and components are designated with the same reference numerals to avoid duplicating description.

Figure 10:
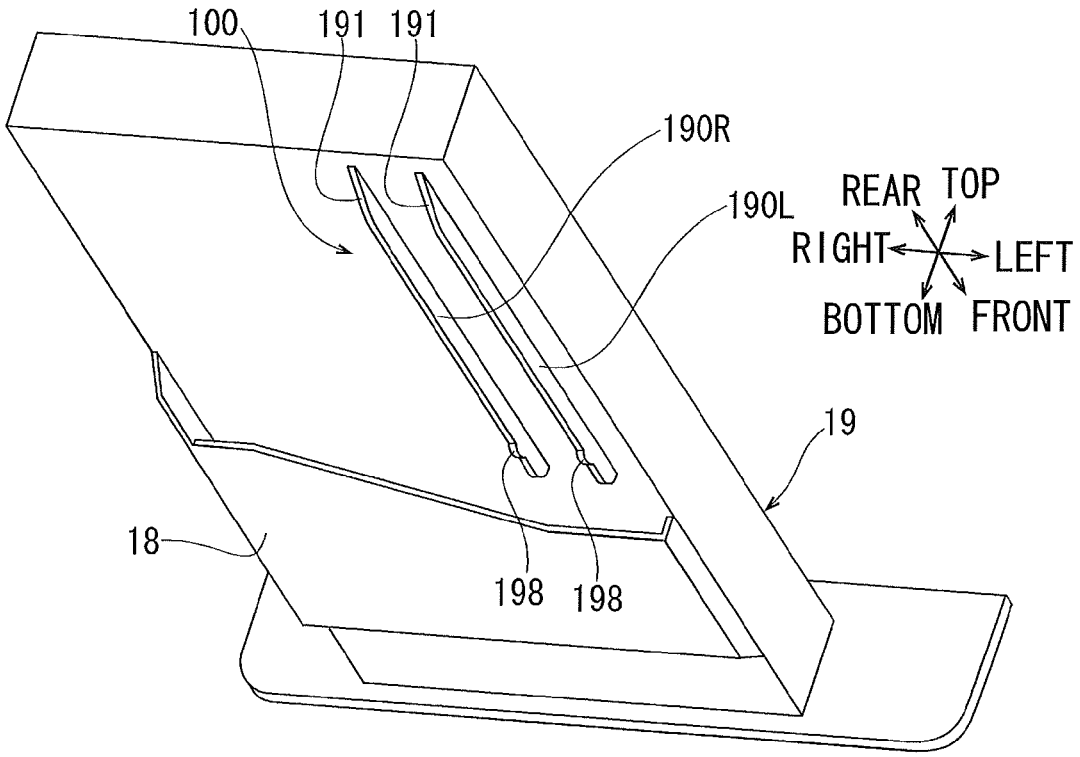
FIG. 10 a perspective view mainly illustrating a bottom surface of a sheet tray of an image forming device according to a second embodiment.
Figure 11:
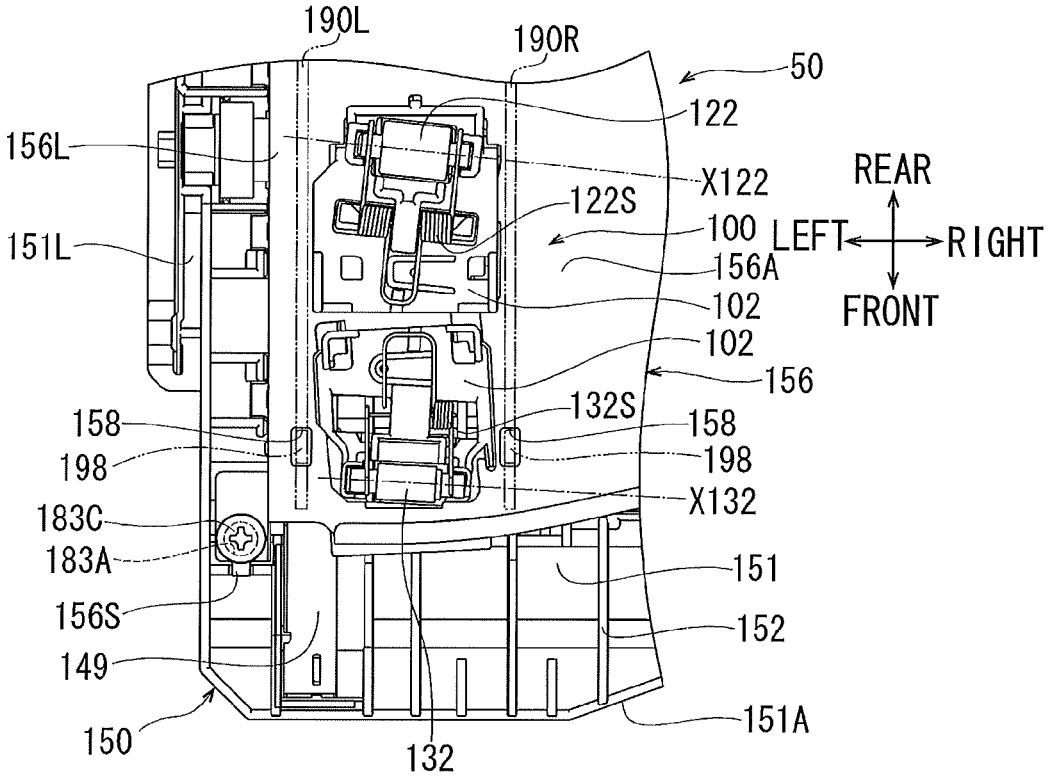
FIG. 11 is a partial top view of a conveying unit of the image forming device according to the second embodiment.

As shown in FIGS. 10 and 11, an image forming device according to the second embodiment lacks the contact sections 171, 172 and 173, the pair of lock levers 158A, and the pair of engagement sections 158B of the image forming device 1 according to the first embodiment. Instead, in the image forming device according to the second embodiment, regulating portions 198 are formed on the pressing sections 190L and 190R, and engagement sections 158 are formed on the upper surface 156A of the opposing member 156. All other configuration of the image forming device according to the second embodiment is the same as that of the image forming device 1 according to the first embodiment.

As shown in FIG. 10, the regulating portions 198 protrude downward from the lower edges of the pressing sections 190L and 190R in such a way as to approach the upper surface 156A of the opposing member 156. As shown in FIG. 11, the regulating portions 198 are formed on the pressing sections 190L and 190R in such a way as to be located roughly on the left and right sides of the pinch roller 132 when the sheet tray 19 is housed in the housing 2.

The engagement sections 158 are formed on the upper surface 156A of the opposing sections 156 so as to be located roughly on the left and right sides of the pinch roller 132 and at locations corresponding to the regulating portions 198.

The engagement sections 158 are square holes passing through in the vertical direction. That is, the engagement sections 158 are formed into a concaved shape in such a way as to separate from the pressing sections 190L and 190R.

The regulating portions 198 slidingly contact with the upper surface 156A of the opposing member 156 in the midst of the loading and unloading operations of the sheet tray 19, thereby pushing down the opposing member 156. In this case, because there are no contact sections 171, 172 and 173 in the image forming device according to the second embodiment, the opposing member 156 is pushed down to the position lower than in the image forming device 1 according to the first embodiment. Then, as shown in FIG. 11, the regulating portions 198 move into the engagement sections 158 after the loading operation of the sheet tray 19 is completed. As a result, the lower edges of the pressing sections 190L and 190R except the regulating portions 198 press the upper surface 156A. Accordingly, the opposing member 156 is pushed down to the same position as in the image forming device 1 according to the first embodiment.

In the image forming device according to the second embodiment having the above configuration, the regulating portions 198 formed on the pressing sections 190L and 90R and the engagement sections 158 formed on the upper surface 156A of the opposing member 156 can lock the sheet tray 19 housed in the housing 2. In this manner, the pair of lock levers 158A as well as the pair of engagement sections 158B according to the first embodiment can be omitted in the image forming device according to the second embodiment. Therefore, the reduction of the number of components helps reduce production costs.

While the invention has been described in detail with reference to the first and second embodiments thereof, it would be apparent to those skilled in the art that various changes and modifications may be made therein without departing from the spirit of the invention.

For example, in the first embodiment, the opposing member 156 swings to move toward and away from the support member 150. However, the present invention is not limited to such configuration. For example, the opposing member may move parallel to the support member.

Moreover, in the first embodiment, the drive rollers 111, 121 and 131 are supported by the support member 150, and the pinch rollers 112, 122 and 132 are supported by the opposing member 156. However, the present invention is not limited to such configuration. For example, the pinch rollers 112, 122 and 132 may be supported by the support member 150, and the drive rollers 111, 121 and 131 may be supported by the opposing member 156.

The present invention is available for image forming device, multifunction peripheral, and any other devices.

What is claimed is:

1. An image forming device comprising:

a housing;

a sheet tray detachably housed in the housing and configured to accommodate a sheet;

an image-forming unit provided in the housing;

a first transport portion configured to feed a sheet to the image-forming unit;

a second transport portion configured to feed the sheet from the image-forming unit;

a third transport portion configured to feed the sheet vertically and connected with the second transport portion;

a fourth transport portion including a first roller and a second roller and configured to feed the sheet horizontally from the third transport portion to the first transport portion; and a switching mechanism disposed between the sheet tray and the fourth transport portion and configured to bring the first roller and the second roller to be in peripheral contact with each other in conjunction with a loading operation of the sheet tray into the housing and separate the first roller and the second roller in conjunction with an unloading operation of the sheet tray from the housing.

2. The image forming device according to claim 1, wherein the first roller is rotatably disposed in a first position to be rotatable about a first rotation axis, the first roller staying in the first position regardless of whether the first roller and the second roller are in a contact state or a separated state;

wherein the second roller is rotatable about a second rotation axis;

wherein the switching mechanism includes a pressing section attached to the sheet tray and configured to press the second roller to move toward the first roller in conjunction with the loading operation; and wherein the pressing section presses both axial end sides of the second roller when the sheet tray is housed in the housing.

3. The image forming device according to claim 2, wherein the fourth transport portion further includes:

a support member having a first major surface and configured to rotatably support the first roller; and an opposing member having a second major surface and disposed in opposition to the support member in a first direction perpendicular to the first major surface, the second roller being rotatably supported in the opposing member and movable toward and away from the support member; and wherein the switching mechanism further includes a pressed section formed in the opposing member and configured to move the opposing member toward the support member when pressed by the pressing section, and wherein the fourth transport portion feeds the sheet along the second major surface.

4. The image forming device according to claim 3, wherein at least one of the pressing section and the pressed section has an inclined portion that is inclined in a second direction perpendicular to the first direction and configured to move the opposing member closer to the support member by contacting another one of the pressing section and the pressed section during the loading operation, the sheet tray being attached to and detached from the housing in the second direction.

5. The image forming device according to claim 3, wherein the switching mechanism further includes a contact section configured to contact one of the support member and the opposing member in response to depression of the pressed section by the pressing section.

6. The image forming device according to claim 3, wherein the switching mechanism further includes an urging section configured to urge the opposing member in the first direction so as to separate the opposing member from the support member; and wherein the urging section is provided at one side of the first roller in the direction of the first rotation axis and the second roller in the direction of the second axis.

7. The image forming device according to claim 2, wherein the fourth transport portion includes a plurality of first rollers provided in a feeding direction of the sheet and a plurality of second rollers provided in the feeding direction to be in one-to-one correspondence with the plurality of first rollers; and wherein the pressing section is configured to press each of the plurality of second rollers to move toward the corresponding one of the plurality of first rollers.

8. The image forming device according to claim 7, wherein the pressing section extends in the feeding direction.

9. The image forming device according to claim 1, wherein the sheet tray has a sheet placement surface configured to support the sheet accommodated in the sheet tray;

wherein the first roller and the second roller are disposed so as to overlap with the sheet tray in a direction perpendicular to the sheet placement surface.

10. The image forming device according to claim 1, wherein the switching mechanism further includes a pressing section configured to press the second roller to move toward the first roller in conjunction with the loading operation; and wherein the first roller and the second roller are provided at one side of the fourth transport portion in a width direction of the sheet, and the pressing section is attached to the same side of the sheet tray as the first roller and the second roller.

* * * * *